US008235616B2

(12) United States Patent
Raccah

(10) Patent No.: US 8,235,616 B2
(45) Date of Patent: Aug. 7, 2012

(54) SAFETY CLOSURE FOR NAIL POLISH BOTTLE

(76) Inventor: Enrico Raccah, Miami, FL (US)

( * ) Notice: Subject to any disclaimer, the term of this patent is extended or adjusted under 35 U.S.C. 154(b) by 81 days.

(21) Appl. No.: 12/944,890

(22) Filed: Nov. 12, 2010

(65) Prior Publication Data

US 2011/0142526 A1 Jun. 16, 2011

Related U.S. Application Data

(60) Provisional application No. 61/272,867, filed on Nov. 12, 2009.

(51) Int. Cl.
*A46B 11/00* (2006.01)

(52) U.S. Cl. ..... 401/129; 401/126; 401/127

(58) Field of Classification Search ..... 401/126–129; 215/201, 219, 220
See application file for complete search history.

(56) References Cited

U.S. PATENT DOCUMENTS

| | | | |
|---|---|---|---|
| 2,710,701 | A | 6/1955 | Hale |
| 3,764,033 | A | 10/1973 | Smith et al. |
| 3,797,688 | A | 3/1974 | Porcelli et al. |
| 4,002,258 | A | 1/1977 | Curry |
| 5,769,252 | A | 6/1998 | Volpe |
| 5,873,475 | A | 2/1999 | Volpe |

*Primary Examiner* — Tuan N Nguyen
(74) *Attorney, Agent, or Firm* — Stein McEwen, LLP

(57) ABSTRACT

A molded, plastic safety closure adapted for use on a nail polish bottle. Closure includes an inner cap, and an overcap that fits over the inner cap in a telescoping manner. Inner cap includes a hollow cylindrical section, a top wall, a plurality of teeth spaced about the top wall, a post extends upwardly from said top wall, and pawls are spaced around the post. Overcap includes a plurality of complementary teeth spaced about its interior, and vanes spaced around the interior of the overcap. The two sets of teeth are normally maintained apart by spring fingers that provide an upwardly directed biasing force. When the closure is subjected to a downwardly directed force, the two sets of teeth are brought in alignment, and the vanes and pawl cooperate to provide a ratchet mechanism. The inner cap and outer cap are rotated as a unit, and provide sufficient torque to unseat the closure, and allow access to the contents of the nail polish bottle.

4 Claims, 5 Drawing Sheets

SAFETY CLOSURE FOR NAIL POLISH BOTTLE

CROSS-REFERENCE TO RELATED APPLICATION

This application claims the benefit of U.S. Provisional Patent Application No. 61/272,867, filed Nov. 12, 2009, the disclosure of which is incorporated herein by reference.

BACKGROUND

1. Field

The invention pertains to safety closures for sealing nail polish bottles, cosmetic bottles, and the like, in an efficient manner.

2. Description of the Related Art

Various closures have been devised to tightly seal nail polish bottles for extended periods of time, while allowing a manicurist to easily open the closure, as needed, to gain access to the contents of the bottle. A nail polish brush, retained within the closure, is used to apply the nail polish to the finger nails of a customer in a known manner. If the closure is secured to the bottle with excessive force, the manicurist will be unable to remove same. Conversely, if the seal is not tight enough, the contents of the bottle may leak during transport or while handling same, ambient conditions may attack, or degrade the nail polish, and diminish its color, luster, and viscosity over time.

Safety closures for containers such as bottles and tubes, which may be opened by simple, manual manipulation as needed, and yet remain fixed, in leak proof sealing position during transport and under normal conditions of operation are well known. In many instances, the safety closure assumes the form on an inner cap seated upon, or otherwise engaged with, the neck of the container, and an outer cap, of slightly larger dimensions and similar shape. The outer cap fits over the inner cap in a telescoping manner. Threads are defined on the exterior of the inner cap, and complimentary threads are defined in interior of the outer cap.

The outer cap may be freely rotated relative to the inner cap, without imparting any rotational force thereto, in most instances. However, in order to couple the outer cap to the inner cap, a mechanical member must be forced, or positioned, on the threads between the outer cap and the inner cap.

U.S. Pat. No. 2,710,701 discloses a safety cap (16) including an inner cap (18) and an outer cap (20); the outer cap is normally freely rotatable about the inner cap. The wide groove (46) and several smaller grooves (48) do not engage the wide lug (30) and the several small lugs (32) at the upper end of the body of the inner cap. However, when the arrow (56) on the inner cap and the indicating mark on the outer cap are aligned, downward pressure on the outer cap will cause the lugs and grooves on the outer cap and inner cap to engage. Split ring (52) is enlarged by the downward force and then returns to its original shape to lock the grooves and lugs together. Consequently, rotational force will loosen, or unseat the cap from the neck of the container.

U.S. Pat. No. 3,764,033, Smith; U.S. Pat. No. 3,797,688, Porcelli; U.S. Pat. No. 4,002,258, Curry; and U.S. Pat. Nos. 5,769,252 and 5,873,475, Volpe, disclose other safety closures of general interest. Volpe, for example, requires that the outer cap or overcap, be squeezed so that the projections on the outer cap are enlarged with the depressions on the exterior of the inner cap, so that the inner and outer cap move in unison.

SUMMARY

Despite the presence of numerous safety closures, addressing diverse commercial needs, the need for an inexpensive, easily molded and assembled, safety closure, with a minimum number of components, remains unfulfilled. Applicant's safety closure, which is molded in plastic at a low cost, with a minimum number of parts, relies upon integrally formed plastic springs, inter alia, and obviates the need for additional mechanical components, such as the resilient ring shown in U.S. Pat. No. 2,760,701, discussed above.

Applicant's closure is capable of being secured to a nail polish bottle in a leak-proof manner, and yet may be easily unsecured or unscrewed multiple times by a manicurist. The unseating is achieved by rotary movement in a specified direction, after the overcap closure has been depressed. Integrally molded springs, between the safety closure, provide the biasing force necessary for opening the closure.

Applicant's closure is formed of two major components, i.e. a base and an overcap, which are molded in a durable, yet attractive, plastic in a variety of colors, and fit together in a cooperative telescoping manner.

Applicant's closure, once seated, is locked securely in sealing position to preserve the contents of the nail polish bottle. The overcap provides a relatively large surface for the manicurist to grip, so that sufficient rotational force can be applied to the closure to unseat same and allow the nail polish brush to be withdrawn from the interior of the bottle. However, the overcap must be depressed, against the bias of spring fingers, before the closure can be rotated in one specific direction to unseat the safety closure.

DETAILED DESCRIPTION

Figure 1:
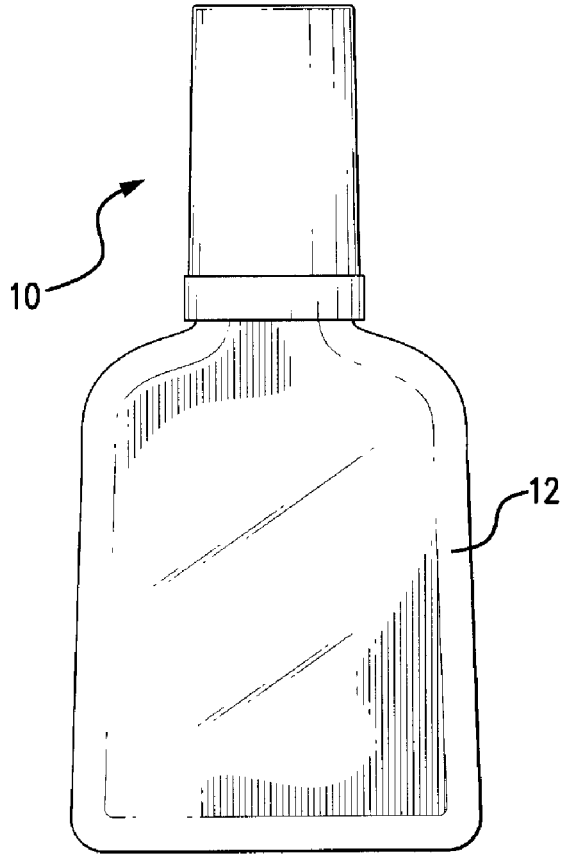
FIG. 1 is a front elevational view of applicant's safety closure secured to a nail polish bottle.

Applicant's safety closure 10 is screwed into engagement with the threads on the exterior of the neck (not shown) of a nail polish bottle 12, as shown in FIG. 1. The bottle may contain nail polish or other non-medicated cosmetic products.

Figure 2:
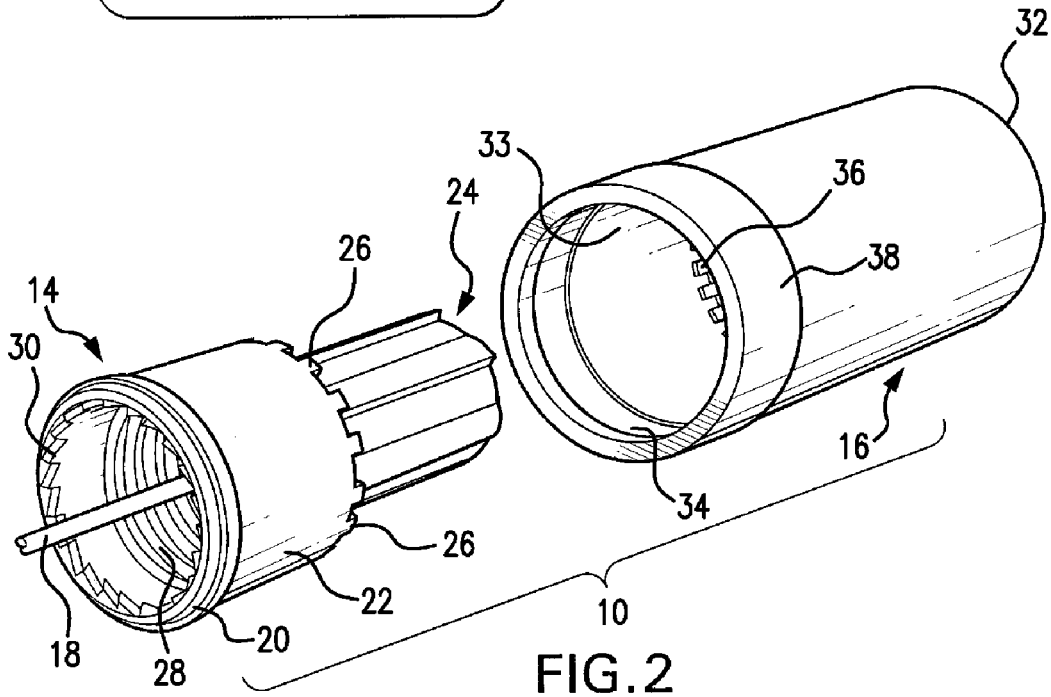
FIG. 2 is an exploded perspective view of applicant's safety closure, with a fragment of a nail polish brush projecting from the base of the safety closure.

FIG. 2 shows that closure 10 comprises two major components, identified as base, or inner cap, 14 and overcap 16. A fragment of a nail polish brush 18, or similar applicator, is retained in inner cap 14 and projects therebelow. Brush 18 depends into the contents of bottle 12, when closure 10 is seated. When closure 10 is removed from bottle 12, the brush is used to apply a limited quantity of the contents of the bottle to the nails of the user or customer.

Inner cap 14 comprises annular lip 20, cylindrical section 22, and an upwardly extending ratchet 24. A plurality of teeth 26, or rectangular shape, extends about the perimeter of cylindrical section 22 at the upper end 27. Screw threads 28 are defined in the interior of section 22, for engagement with the threads (not shown) on the neck of bottle 12. Serrations 30 are provided on the lower, interior surface of cylindrical section 22 to grip the exterior of bottle 12 and anchor the safety closure to container 12.

Figure 3:
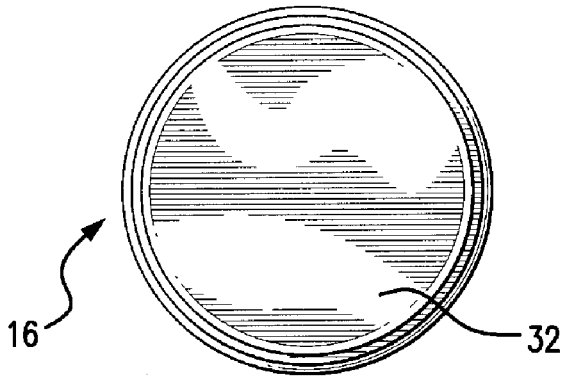
FIG. 3 is a top plan view of the overcap of applicant's safety closure.
Figure 4:
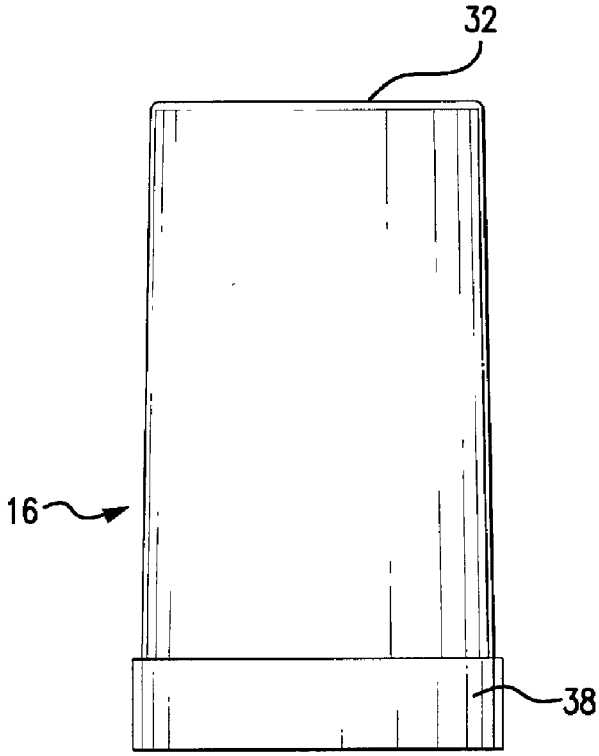
FIG. 4 is an elevational view of the overcap of applicant's safety closure.

Overcap 16 is generally cylindrical in shape to slip over base 14. Top 32 closes the upper end of overcap 16, as shown in FIGS. 2-4, and the lower end of overcap 14 opens into an interior bore 33. An annular recess 34 is located near the open end of overcap 16 to receive annular lip 20 on inner cap 14. A plurality of downwardly projecting teeth 36, of rectangular configuration, are distributed about the interior face of overcap 16 in the middle of bore 33. Teeth 36 are similar in size, configuration, and spacing, to teeth 26 on inner cap 14, and cooperate therewith when brought into engagement. An external bead 38 encircles the lower end of overcap 16, and groove 34 is formed within the bead.

Figure 5:
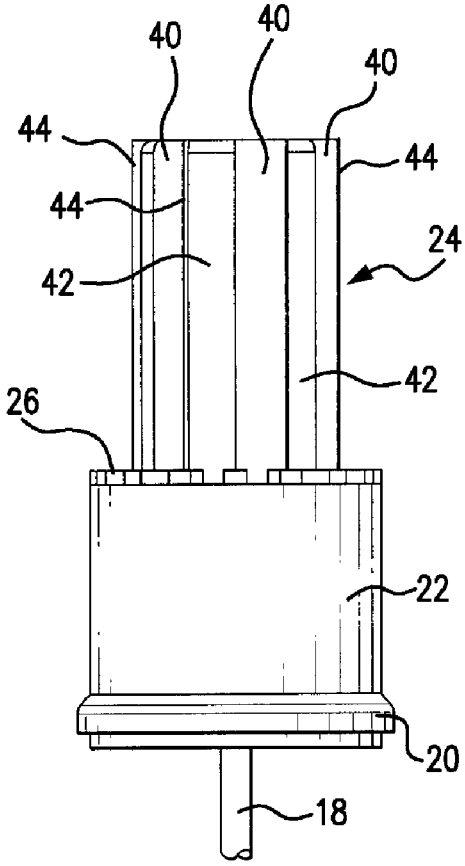
FIG. 5 is an elevational view of the base of applicant's safety closure.
Figure 8:
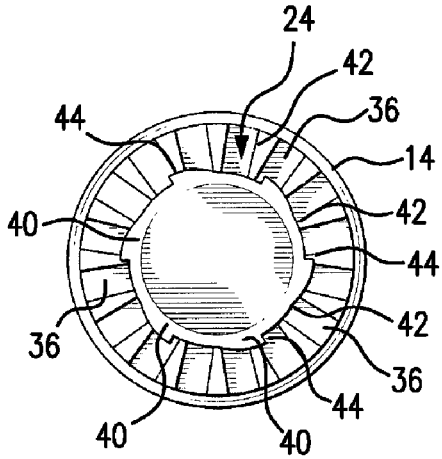
FIG. 8 is a top plan view of the base of applicant's safety closure.

FIGS. 3 and 4 show additional details of overcap 16. FIGS. 5 and 8 show additional details of inner cap 14, particularly the ratchet mechanism indicated generally by reference numeral 24. Ratchet 24 comprises an upstanding post 39 having series of vertically extending vanes 40 alternating with a series of recesses 42 or depression in the vanes. One corner of each vane 40 projects radially outwardly to define a ratchet tooth 44, so that several ratchet teeth are formed on the exterior of part 39 of ratchet 24.

Figure 6:
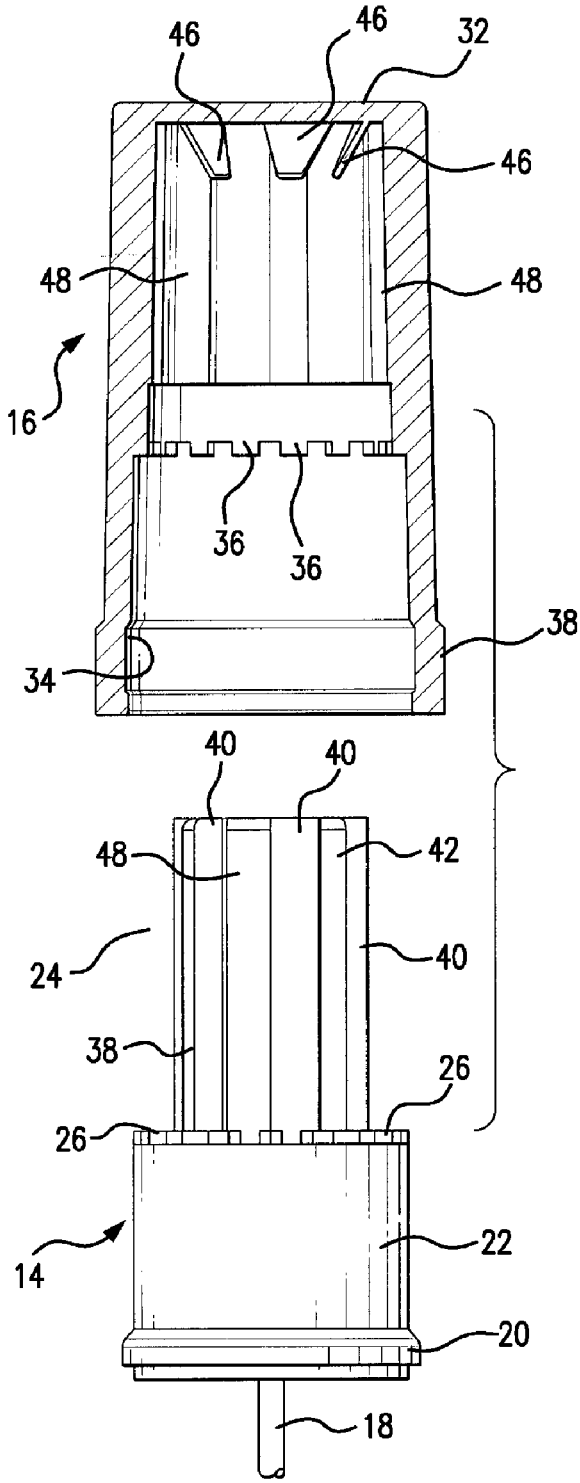
FIG. 6 is a vertical cross-sectional view through the overcap of applicant's safety closure, with the overcap positioned above the base of the safety closure.
Figure 9:
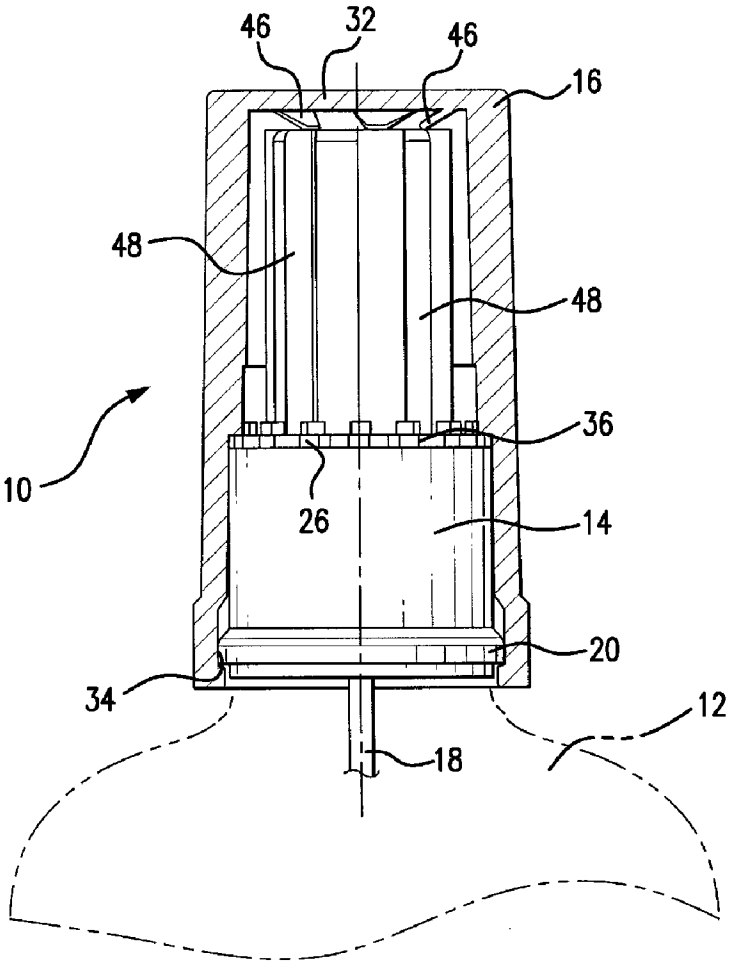
FIG. 9 shows applicant's closure seated upon the neck of a nail polish bottle, in sealing position.
Figure 11:
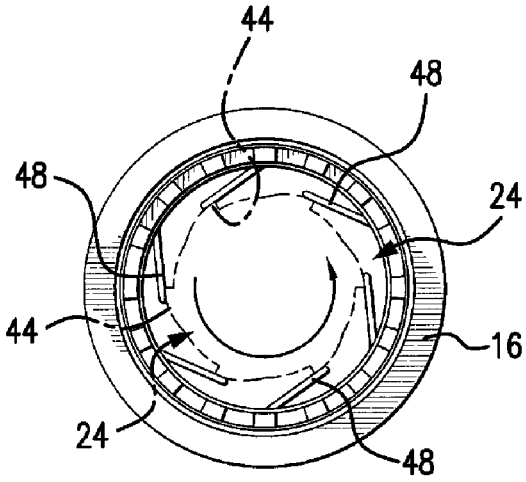
FIG. 11 depicts the counterclockwise movement of the overcap relative to the base of applicant's safety closure.
Figure 12:
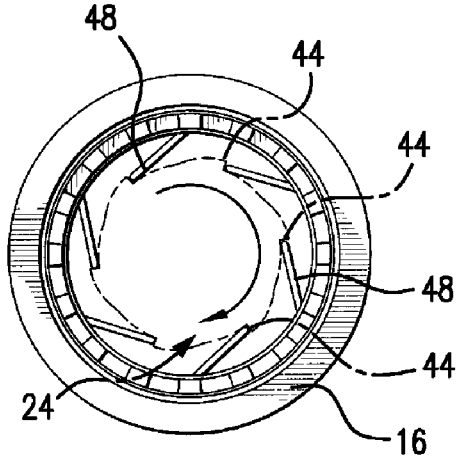
FIG. 12 depicts the clockwise movement of the overcap relative to the base of the applicant's safety closure.

FIG. 6 also shows additional details of the interior of overcap 16. To illustrate, a series of integrally formed compression springs or spring fingers 46, are spaced around the underside of top 32 of the overcap. Spring fingers 46 normally press downwardly against the upper surface of post 39, ratchet 24, and retain lip 20 on cap 14 seated at the lower end of annular recess 34 in overcap 16, as shown in FIG. 9. In such position, the application of a rotary force to overcap 16 will allow the overcap to rotate freely relative to inner cap 14, and teeth 26 on the base will rotate past teeth 36 in the overcap, without engaging same.

Figure 10:
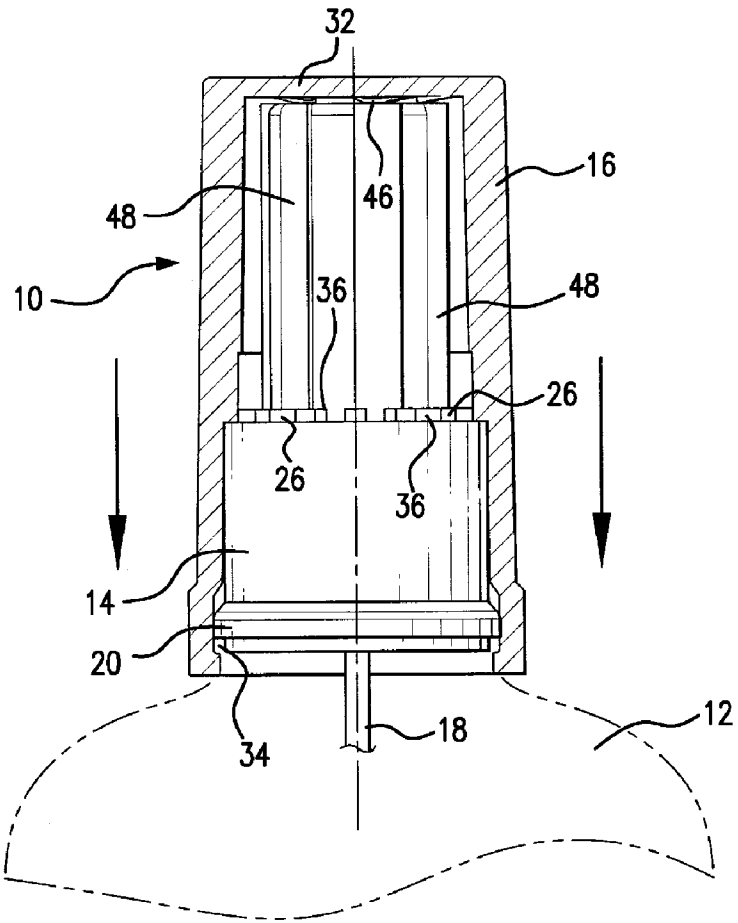
FIG. 10 shows the overcap being pressed downwardly upon the base of applicant's safety closure; the directional arrows indicate the movement of the overcap.

However, when a downward axially directed force is applied to overcap 16, as shown in FIG. 10, the bias of the spring fingers 46 is overcome, and teeth 26 on cylindrical section 22 of base 14 engage, in an interlocking manner, with teeth 36 on overcap 16. Alternatively the spring fingers could be molded on the upper surface of top 32 of base 14 and function satisfactorily.

The extent of downward movement of overcap 16 relative to base 14 is determined by the vertical dimension of annular recess 34, located in the bore of overcap 16, as shown by a comparison of FIGS. 9 and 10. The downward movement of the overcap 16 couples same to inner cap 14.

Figure 7:
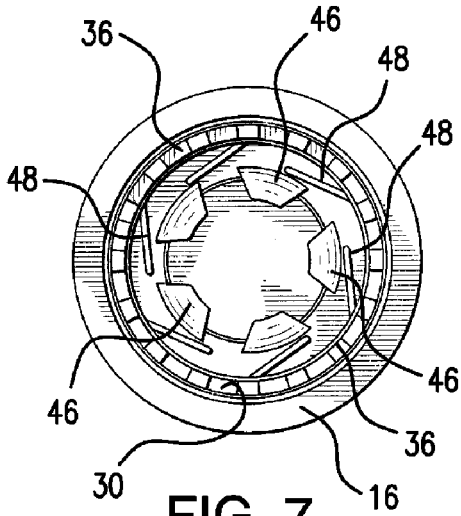
FIG. 7 is a bottom plan view of the overcap of applicant's safety closure.

FIGS. 6 and 7 also show a series of vertically oriented pawls 48, which extend between the upper end of teeth 36 and the lower end of spring fingers 46 in overcap 16. After overcap 16 is coupled to inner cap 14, by the downward movement of overcap 16, a rotary force is applied in a first direction, e.g. clockwise. Pawls 48 engage ratchet teeth 44, so that the outer cap and the inner cap rotate as a unit. Conversely, if a rotary force is applied in a section direction, e.g. counterclockwise, pawls 48 slip past ratchet teeth 44, and the closure remains in its closed condition.

The compound action required by the operator, i.e. downward pressure on the outer cap to depress same, followed by a twisting or rotating action in a particular direction, i.e. clockwise to open the safety closure, insures that the safety closure will not be easily overcome and the contents of the bottle will not be readily compromised.

The cycle of operation for safety closure 10 may be summarized in the following manner. An empty nail polish bottle 12 is filled, with a nail polish of a desired color, by an operator or nail technician, or automatically, as in a high speed production line. A safety closure 10, with an applicator 18, is seated upon the neck and screw threads 28 if inner cap 12 are threaded onto bottle 12.

In order to unscrew the closure, a compound motion is required. The compound motion includes (1) depressing overcap 16 so that the internal fingers 46, in the overcap, shift teeth 36 into cooperative relationship with teeth 26 on inner cap 14, and (2) applying a rotational force to the overcap. Ratchet 24 includes vanes 40 and recesses 42. The edges of the vanes function as ratchet teeth 44. Pawls 48 engage ratchet teeth 44, so that the outer cap and the inner cap rotate as a unit, and allow brush 18 to be removed from the bottle for application of nail polish to the nails of a customer.

After the nail treatment is completed, the threads 28 on inner cap 14 are roated into engagement with the threads on the neck of bottle 12. Spring fingers 46 contact the upper end of ratchet 24, as shown in FIG. 9, and urge or bias overcap 16 upwardly, so that teeth 36 are located out of engagement with teeth 26 on inner cap or base 14. The overcap may be rotated relative to the inner cap, in a ratchet-like step-by-step manner, as ratchet teeth 42 slip past pawls 48 on the interior of the overcap.

Modifications and revisions to the safety closure may occur to the skilled artisan; for example, spring fingers 46 could be molded on top of post 369 and extend upwardly toward overcap 16. The positions of the vanes and pawls may be reversed. Consequently, the appended claims should be broadly construed, and should not be limited to their listed terms.

The invention claimed is:

1. A safety closure adapted for use on a nail polish bottle with an upstanding neck, said closure comprising:

a) an inner cap, said inner cap comprising
   1) a hollow cylindrical section,
   2) a top wall closing one end of said cylindrical section,
   3) a plurality of teeth spaced above the exterior surface of said top wall,
   4) threads formed in the interior of said cylindrical section for engagement with a nail polish bottle
   5) a post extending upwardly from said wall of said cylindrical section, and a plurality of pawls spaced around said post;
   6) a brush contained within said hollow cylindrical section and extending downwardly therefrom, b) an overcap, said overcap comprising
   1) a hollow body,
   2) said hollow body configured to fit over said inner cap in a telescoping manner,
   3) a top wall closing one end of said hollow body,
   4) a plurality of teeth spaced about the interior of said overcap, 5) spring fingers located within said overcap, said spring fingers normally exerting brasing force upon said inner cap so that said teeth on said overcap are located out of engagement with said teeth on said inner cap, 6) whereby, when a downwardly divided force of sufficient magnitude to overcome the brasing force on said spring fingers, said teeth on said overcap are engaged with said teeth on said inner cap so that said overcap and said inner cap can be rotated together to open the safety closure and expose the contents of the nail polish bottle.

2. The safety closure as defined in claim 1 wherein said spring fingers are integrally molded with said overcap, and said fingers are spaced about the inner surface of said top wall of said overcap and extend downwardly toward said post in said inner cap.

3. The safety closure as defined in claim 1 wherein an enlarged annular lip is located adjacent to the lower end of said inner cap, and a groove is located adjacent to the lower end of said cylindrical section of said overcap, said annular lip fitting into said groove to retain said inner cap within said outer cap.

4. The safety closure as defined in claim 3 wherein said annular lip moves axially within said groove in response to the application of axially directed forces.

* * * * *